US009145639B2

(12) United States Patent
Vandrovcova et al.

(10) Patent No.: US 9,145,639 B2
(45) Date of Patent: Sep. 29, 2015

(54) CORD EYE

(71) Applicant: TEUFELBERGER GESELLSCHAFT M.B.H., Wels (AT)

(72) Inventors: Pavla Vandrovcova, Ceské Budejovice (CZ); Rene Mäser, Amstetten (AT); Rudolf Kirth, Vöcklabruck (AT); Christopher Sidney Cowell, Pitlochry (GB)

(73) Assignee: TEUFELBERGER GESELLSCHAFT M.B.H., Wels (AT)

( * ) Notice: Subject to any disclaimer, the term of this patent is extended or adjusted under 35 U.S.C. 154(b) by 0 days.

(21) Appl. No.: 14/360,880

(22) PCT Filed: Nov. 27, 2012

(86) PCT No.: PCT/EP2012/073667

§ 371 (c)(1),
(2) Date: May 27, 2014

(87) PCT Pub. No.: WO2013/079459

PCT Pub. Date: Jun. 6, 2013

(65) Prior Publication Data

US 2015/0121833 A1 May 7, 2015

(30) Foreign Application Priority Data

Nov. 28, 2011 (AT) ..... A 1750/2011

(51) Int. Cl.
*D07B 1/18* (2006.01)

(52) U.S. Cl.
CPC ..... *D07B 1/185* (2013.01)

(58) Field of Classification Search
CPC ..... D07B 1/185
USPC ..... 57/22, 202
See application file for complete search history.

(56) References Cited

U.S. PATENT DOCUMENTS 2,413,642 A * 12/1946 Mitchell ..... 87/8
3,102,715 A 9/1963 Weitzel et al.

(Continued)

FOREIGN PATENT DOCUMENTS

| | | | |
|---|---|---|---|
| DE | 8908952 | U1 | 11/1989 |
| EP | 0768100 | B1 | 8/2001 |
| EP | 1659209 | A2 | 5/2006 |
| EP | 2028308 | A2 | 2/2009 |
| EP | 2186551 | A1 | 5/2010 |

(Continued)

OTHER PUBLICATIONS

Anonymous: "Yale Cordage Splicing Instructions—industrial double braid eye splice", Internet Citation, Nov. 28, 2006, p. 1-5, XP002507388.

(Continued)

*Primary Examiner* — Shaun R Hurley
(74) *Attorney, Agent, or Firm* — Workman Nydegger

(57) ABSTRACT

The invention relates to a rope end which is spliced, whereby a loop is formed, comprising a rope end piece folded back in order to form the loop and a rope section leading to the loop, wherein a spliced area is provided in which the rope end piece is guided within the rope section leading to the loop, and wherein the rope is a core/sheath rope. The rope end according to the invention is characterized in that, in the rope end piece, part of the core, preferably the entire core, is removed in the spliced area, that a load-bearing sewing of the rope end piece to the rope section leading to the loop is provided in the spliced area and that a load-bearing sewing is provided in an area of the rope section leading to the loop which comprises part of the core, preferably the entire core.

12 Claims, 1 Drawing Sheet

(56) References Cited

U.S. PATENT DOCUMENTS

| | | | | |
|---|---|---|---|---|
| 3,276,810 | A * | 10/1966 | Antell | 294/74 |
| 5,152,130 | A | 10/1992 | McGrew | |
| 5,205,803 | A | 4/1993 | Zemitis | |
| 5,829,374 | A * | 11/1998 | Hede et al. | 112/400 |
| 7,399,018 | B1 | 7/2008 | Khachaturian | |
| 7,703,372 | B1 * | 4/2010 | Shakespeare | 87/6 |
| 2007/0137163 | A1 | 6/2007 | Hess | |

FOREIGN PATENT DOCUMENTS

| | | | |
|---|---|---|---|
| GB | 1480826 | A | 7/1977 |
| WO | WO2008/069380 | A1 | 6/2008 |
| WO | WO2011/071387 | A1 | 6/2011 |

OTHER PUBLICATIONS

PCT/EP2012/073667, Apr. 18, 2013, English Translation of International Search Report.

* cited by examiner

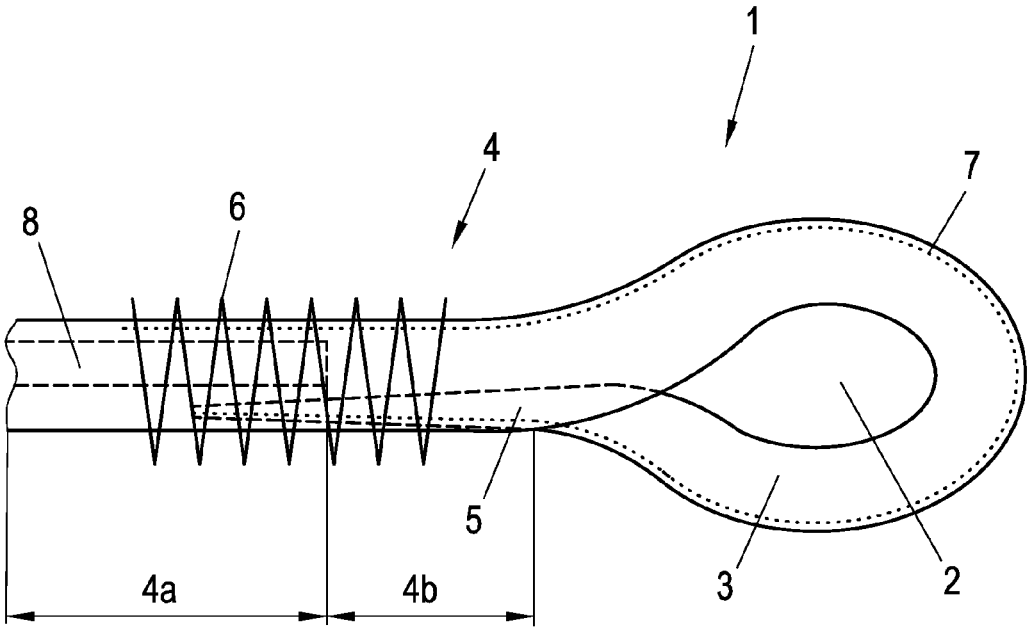
1
4
7
8
6
5
3
2
4a
4b

CORD EYE

CROSS REFERENCE TO RELATED APPLICATIONS

This application is a U.S. Nationalization of PCT Application Number PCT/EP2012/073667, filed on Nov. 27, 2012, which claims priority to Austrian Patent Application No. A 1750/2011, filed on Nov. 28, 2011, the entireties of which are incorporated herein by reference.

The present invention relates to an end of a rope which is spliced, whereby a loop is formed.

In various fields of technology, for example, on the sector of yacht ropes or on the sector of personal security or climbing, rope ends are required which are designed in the form of a loop or an eye, respectively. The rope end must thereby be secured in such a way that the tensile forces occurring in the respective field of application can be absorbed without the loop becoming loose.

Two basic methods of forming a loop in the area of the rope end are known:

In the first method, the rope end piece is folded back in order to form a loop, laid over a certain distance on the rope section leading to the loop and fastened with said section, for example, via a sewing. A corresponding system is known, for example, from EP 0 768 100 B1, EP 1 659 209 A2 and US 2007/0137163 A1.

Those systems can be manufactured by means of machines, resulting in a low proneness to errors. Due to the abrupt transition from the rope to the loop, on the one hand, a non-appealing optical appearance is created and, on the other hand, the risk also exists that the rope end or the loop, respectively, might become entangled on obstacles, for example, a branch, because of this transition. Said transition may indeed be mitigated by slanting the rope end, but cannot be avoided completely.

Alternatively, it has for a long time been known to splice the rope end, that is, to insert the rope end piece which has been folded back into the rope section leading to the loop and to guide it in the rope section over a certain distance.

Under a tensile load, the spliced rope end piece is clamped within the rope section so that the loop will not become loose. However, for this purpose, it is necessary to guide the rope end piece over a relatively long distance (in the following referred to as the "splice length") within the rope section leading to the loop. A splice produced in this way has no abrupt transition, but runs with a uniform tapering from the loop or the eye, respectively, to the rope.

Spliced rope ends are described, for example, in U.S. Pat. No. 3,102,715 A, GB 1 480 826 A and WO 2011/071387 A1.

A rope end spliced in this way can be manufactured only by hand, which, however, involves a certain risk of errors. Just in applications in which the safety aspect plays a major role, each splice must exhibit the same breaking load. Because of the strong influence which the dexterity of the person producing the splice has on the quality of the splice, this is guaranteed only to an insufficient extent.

From EP 2 186 551 A1, a spliced rope end is known which is characterized in that the spliced area is spaced apart from the loop by a sewing area in which the rope end piece and the rope section leading to the loop are situated adjacent to each other and are sewn to each other via a load-bearing sewing.

U.S. Pat. No. 5,205,803 A and WO 2008/069380 A1 describe the sewing of woven or knitted band-shaped elements.

The rope end described in EP 2 186 551 has, in fact, no abrupt transition and is secured by a machine- (reproducibly-) made seam, however, the rope end or the loop, respectively, and the spliced area are still substantially thicker and more bulky, respectively, in relation to the rope diameter and hence are stiffer—as with the above-described rope sewings and splices.

The stiffness and the thickness are a problem particularly if, for working in trees, a fall protection device is used, since the rope might still become entangled on obstacles (branches).

It is the object of the present invention to provide a rope end which is spliced and secured with a sewing and which is designed more advantageously with regard to its stiffness and thickness, as opposed to rope ends as known from the prior art.

Said object is achieved by means of an end of a rope which is spliced, whereby a loop is formed, comprising a rope end piece folded back in order to form the loop and a rope section leading to the loop, wherein a spliced area is provided in which the rope end piece is guided within the rope section leading to the loop, and wherein the rope is a core/sheath rope which is characterized in that, in the rope end piece, part of the core, preferably the entire core, is removed in the spliced area, that a load-bearing sewing of the rope end piece to the rope section leading to the loop is provided in the spliced area and that a load-bearing sewing is provided in an area of the rope section leading to the loop which comprises part of the core, preferably the entire core.

SHORT DESCRIPTION OF THE FIGURE

FIG. 1 schematically shows the construction of a preferred embodiment of a rope end according to the invention.

DETAILED DESCRIPTION OF THE INVENTION

According to the present invention, a spliced rope end of a core/sheath rope is provided in which, in the rope end piece, the core or, respectively, part of the core is removed at least in the spliced area.

As is generally known, core/sheath ropes may comprise a single core (e.g., yarns braided into a rope), or, however, a core consisting of several parts which are detachable from each other (e.g., several yarns twisted into twines, with the twines lying next to each other without any connection therebetween).

For the purposes of the present invention, the term "part of the core" signifies a part of the materials forming the core, e.g., a part of the twines forming the core.

Accordingly, "removing part of the core" is to be understood as the removal of at least part of the materials forming the core, e.g., by removing one of several twines forming the core, but also by separating one or several yarns from a rope contained in the core.

In contrast, the term "the entire core" signifies the core in its form as present in the remaining rope, i.e., with all the materials forming the core such as, e.g., all twisted or braided yarns.

In a preferred embodiment of the present invention, in all areas of the rope end in which, according to the invention, part of the core is removed, the entire core (that is, all parts of the core) is removed in each case.

Thus, the term "part of the core" is to be understood as "at least part of the core".

If, vice versa, a removal of "the core" is mentioned in the following, this should, in each case, be understood also as the removal of only part of the core, unless a removal of the entire core is explicitly indicated.

Due to the removal of the core in the rope end piece, the remaining sheath is compressible and thus exhibits a smaller diameter in the spliced area than the original core/sheath rope. However, the result is also that, in comparison to the normal thickness of the rope, the spliced area as such will exhibit a smaller increase in thickness than ropes as known from the prior art or, respectively, that virtually no increase in thickness will even occur.

A load-bearing sewing is provided for securing the spliced rope end. Optionally, the sewing may be provided in the form of several sewings separated from each other. At least one load-bearing sewing of the rope end piece to the rope section leading to the loop in the spliced area and one load-bearing sewing in the area of the rope section leading to the loop in which part of the core, preferably the entire core, is present must be provided.

For the purposes of the present invention, the term "load-bearing sewing" means that the sewing is stable relative to tensile loads which occur when the respective rope is being used, i.e., neither becomes loose nor breaks. In particular, a load-bearing sewing in terms of the present invention is able to ensure, in a safety rope according to EN 1891, a minimum breaking load of the rope end of at least 10 kN, preferably of at least 15 kN, measured according to EN1891:1998, Section 5.10.1. Such ropes have a diameter ranging from 8.5 to 16 mm. For ropes with diameters deviating therefrom, correspondingly smaller and higher minimum breaking loads, respectively, are to be ensured. The manufacture of such load-bearing sewings is known per se to a person skilled in the art, see, for example, EP 0 768 100 B1.

Preferably, the sewing is machine-made or, respectively, the sewings are machine-made. The material for the sewing can be chosen arbitrarily; seams of polyethylene terephthalate (PET), polyamide (PA) or high molecular weight polyethylene (HMW-PE; known by the name of Dyneema®) are preferred.

Preferably, the core is removed in the rope end piece also in the area of the loop. The result is that also the loop itself will exhibit no or, respectively, only a small increase in thickness relative to the normal thickness of the rope.

An area in which the core is removed can be provided also in the rope section leading to the loop. This also leads to a further reduction in the thickness of the rope end. In this embodiment, the core can be removed in the rope section also over at least part of the spliced area.

Thereby, it is merely important that the sewing provided according to the invention comprises in any case an area of the rope section leading to the loop in which part of the core, preferably the entire core, is present. If part of the core is removed also in the area of the sewing in the rope section leading to the loop, a person skilled in the art will understand that at least enough material of the core must remain in order to ensure the tensile load resistance of the rope in connection with the sewing.

Preferably, the spliced area and the area of the rope section leading to the loop which exhibits part of the core overlap. This means that the rope end piece without a core or, respectively, with only part of the core, which is guided within the rope section, abuts on the core present in the rope section at least partially.

In particular in this embodiment, a single continuous load-bearing sewing is preferably provided.

In a further preferred embodiment, at least part of the area of the rope end piece in which the core is removed is additionally tapered. This can be effected in particular by removing part of the material forming the sheath, for example, by progressively removing individual or several yarns. As a result, a further reduction in the thickness of the rope end will occur.

In a further preferred embodiment, a reinforcing element of the rope end, which element is different from the core, is provided at least in a portion of the area of the rope end piece in which the core is removed.

A reinforcing element of the rope end may also be provided at least in a portion of the area of the rope section leading to the loop in which the core is removed. Likewise, a reinforcing element may also be provided at least in a portion of the area of the rope section leading to the loop which comprises part of the core.

Preferably, a continuous reinforcing element is provided.

Preferably, the reinforcing element is arranged in the interior of the sheath. Said reinforcing element can assume different tasks such as, for example, the stabilization of the shape of the loop. The reinforcing element preferably serves for increasing the tensile load resistance of the rope end.

The sheath of the rope which remains after the removal of the core is load-bearing. If it is rubbed off, the system loses in tensile load resistance.

Therefore, a tensile-load resistant reinforcing element is preferably provided, which is preferably arranged in the interior of the sheath.

The shape and the design of the reinforcing element fit the objective thereof. In particular, the reinforcing element may be provided in the form of a flat band.

Preferably, at least part of the reinforcing element is also covered by the sewing provided according to the invention or, respectively, the sewings provided according to the invention.

A particularly preferred embodiment of the rope end according to the invention is characterized in that

- the entire core is removed in the entire rope end
- the rope section leading to the loop exhibits an area in which the entire core is present
- the rope section leading to the loop exhibits an area in front of the loop in which the entire core is removed, and
- the spliced area and the area of the section leading to the loop in which the entire core is present overlap.

Also in this embodiment, a single continuous sewing is preferably provided.

A further aspect of the present invention concerns a rope which comprises a rope end according to the invention.

The rope end or the rope according to the invention, respectively, is constructed in a manner known per se as a core/sheath rope, wherein all materials and structures known in this field can be used for the core and the sheath, respectively, such as, e.g., high-strength polyamide or polyester materials.

High-strength materials such as, e.g., Dyneema® (HMWPE), aramide and Vectran® (LC polyester) are possible materials for the preferably provided reinforcing element, in particular in the form of a band. The reinforcing element may be provided, for example, in a woven or braided state, in particular in the form of a collapsible hollow weave.

EXAMPLES

The following explanation of FIG. 1 relates to an embodiment with a single core (i.e., a core consisting, for example, of yarns braided into a rope). The explanations apply analogously also to embodiments with a core consisting of several parts.

FIG. 1 schematically shows a rope end 1 of a core/sheath rope. The core of the rope is illustrated schematically with reference numeral 8. In the rope end 1 as illustrated in the FIGURE, a loop 2 is formed by folding back the rope end piece 3. The rope end piece 3 is spliced with the rope section 4 leading to the loop 2 in a known manner in that it is inserted into the rope section 4 and runs over a certain range within the rope section. The area between the first point, as seen from the loop, where the end piece touches the rope section 4 and enters into it (e.g., in the form of a puncture), up to the end of the end piece 3, is referred to as the spliced area 5.

In the embodiment illustrated in FIG. 1, the (entire) core is removed in the rope end piece in the entire spliced area 5, but also in the entire area of the loop 2. The (entire) core is removed also in a part of the rope section 4 leading to the loop. The result is that a part 4*a* of the rope section is with a core 8 and a part 4*b* of the rope section is without a core.

According to the invention, a load-bearing sewing 6 is provided.

In a part of the spliced area 5, said sewing sews the (core-less) rope end piece 3 to the rope section 4 leading to the loop. In sections, the load-bearing sewing also comprises the part 4*a* of the rope section 4 leading to the loop which exhibits a core 8.

In FIG. 1, the sewing 6 is illustrated as a single continuous sewing. However, several sewings separated from each other are possible as well.

According to FIG. 1, the spliced area 5 and the part 4*a* of the rope section 4 exhibiting a core preferably overlap in parts. The sewing 6 thereby covers a part of the spliced area 5 in which the core is removed both in the rope section 4 and in the rope end piece 3 and a part of the spliced area 5 in which the rope section 4 exhibits a core 8.

The areas of the rope end 1 in which no core is present may be tapered further, which is illustrated in FIG. 1 only schematically for the rope end 3 in the spliced area 5.

Preferably, a reinforcing element 7 (illustrated as a dotted line) is provided in the rope end 1. As shown in FIG. 1, said element may extend continuously from the rope section 4 up to the end of the spliced area 5 or even beyond, respectively. As shown in FIG. 1, the reinforcing element 7 is also preferably covered by the sewing 6.

Examples 1 to 4

Rope ends according to the invention were manufactured from ropes of the following types:

Rope 1: a core-sheath rope (DM 11.5 mm) having a PET sheath (24 braids) and a core of several twisted PA twines.*

Rope 2: a core-sheath rope (DM 11.5 mm) having a PET sheath (24 braids) and a core with a braided small PA rope as well as central twines of polyolefin.

Rope 3: a core-sheath rope (DM 13 mm) having a PA sheath (16 braids) and a core of several twisted PA twines.

Rope 4: a core-sheath rope (DM 13 mm) having a PET/polyolefin sheath (16 braids) and a core of several twisted PA twines.

*PET: polyester; PA: polyamide

At first, the maximum tensile force (HZK) of the original rope was measured in the free length.

For determining the maximum tensile force of the sheath without core(s), the entire core (that is, all components of the core) was removed. The maximum tensile force of the remaining sheath was measured in the free length.

For the production of rope ends according to the invention, the entire core was removed in each case. The core-less rope end piece was in each case folded back to form a loop and spliced with the rope section leading to the loop and sewn up in a load-bearing manner, as it is schematically illustrated in FIG. 1.

The maximum tensile force of the resulting loop was measured.

In case of the ropes 1 and 2, a further embodiment with a reinforcing element in the form of a small band made of Dyneema® and having a width of 10 mm and a thickness of 1.4 mm was produced, which was arranged and integrated by sewing as it is schematically illustrated in FIG. 1.

In those cases, the maximum tensile force of the loop including the reinforcing element was measured. For comparison purposes, the maximum tensile force of the loop was additionally measured after the sheath had been cut through (that is, when only the reinforcing element is still provided as a load-bearing element).

The results are illustrated in the following table:

TABLE

| Rope type | HZK in free length [kN] | HZK of the sheath in free length [kN] | HZK of the loop without reinforcing element [kN] | HZK of the loop with reinforcing element [kN] | HZK of the loop only with reinforcing element (sheath cut through) [kN] |
|---|---|---|---|---|---|
| Rope 1 | 32.9 | 15.0 | 20.2 | 20.2 | 17.1 |
| Rope 2 | 31.1 | 14.9 | 18.3 | 18.5 | 16.7 |
| Rope 3 | 37.4 | 27.6 | 22.0 | | |
| Rope 4 | 31.1 | 25.1 | 21.1 | | |

From the above table, it is evident that, despite the removal of the entire core, the resulting loop exhibits a tensile load resistance which is still adequate. At the same time, the resulting rope end is much thinner in comparison to conventional spliced rope ends.

The invention claimed is:

1. A rope end which is spliced, whereby a loop is formed, comprising:

a rope end piece folded back in order to form the loop;

a rope section leading to the loop, wherein a spliced area is provided in which the rope end piece is guided within the rope section leading to the loop, and wherein the rope is a core/sheath rope, wherein, in the rope end piece, part of the core is removed in the spliced area, a load-bearing sewing of the rope end piece to the rope section leading to the loop is provided in the spliced area and a load-bearing sewing is provided in an area of the rope section leading to the loop which comprises part of the core and a reinforcing element, which is different from the core, provided at least in a portion of the area of the rope end piece in which part of the core is removed, wherein at least part of the reinforcing element is covered by the sewing.

2. A rope end according to claim 1, characterized in that part of the core is removed in the rope end piece also in the area of the loop.

3. A rope end according to claim 1, characterized in that the spliced area and the area of the rope section leading to the loop which exhibits part of the core overlap.

4. A rope end according to any of claim 1, characterized in that a single continuous load-bearing sewing is provided.

5. A rope end according to claim 1, characterized in that at least part of the area of the rope end piece in which part of the core is removed is additionally tapered.

6. A rope end according to claim 1, characterized in that a reinforcing element, which is different from the core, is provided at least in an area of the rope section in which part of the core is removed.

7. A rope end according to claim 1, characterized in that the reinforcing element is tensile-load resistant.

8. A rope end according to any of claim 1, characterized in that a continuous reinforcing element is provided.

9. A rope end according to any of claim 1, characterized in that the reinforcing element is provided in the form of a flat band.

10. A rope end according claim 1, characterized in that, in those areas of the rope end in which part of the core is removed, the entire core is removed in each case.

11. A rope end according to claim 1, characterized in that the entire core is removed in the entire rope end, the rope section exhibits an area in which the entire core is present, the rope section exhibits an area in front of the loop in which the entire core is removed, and the spliced area and the area in which the entire core is present overlap.

12. A rope comprising a rope end according to claim 1.

* * * * *